US007534325B2

(12) United States Patent
Quigley et al.

(10) Patent No.: US 7,534,325 B2
(45) Date of Patent: May 19, 2009

(54) COMPOUND PAPER MAKING FABRIC

(76) Inventors: Scott Quigley, 1203 Hunter Crossing, Bossier City, LA (US) 71111; Martin Ringer, 11 Carrwood Hey, Ramsbottom, Bury, Lancashire (GB) BL0 9QT ( * ) Notice: Subject to any disclaimer, the term of this patent is extended or adjusted under 35 U.S.C. 154(b) by 254 days.

(21) Appl. No.: 11/471,748

(22) Filed: Jun. 20, 2006

(65) Prior Publication Data

US 2007/0006935 A1 Jan. 11, 2007

(51) Int. Cl.
*D21F 1/10* (2006.01)
*D03D 25/00* (2006.01)

(52) U.S. Cl. ..... 162/348; 162/903; 139/383 A; 139/425 A

(58) Field of Classification Search ..... 162/116, 162/348, 358.1, 358.2, 900–904, 361; 139/383 A, 139/425 A, 383 AA, 408–410
See application file for complete search history.

(56) References Cited

U.S. PATENT DOCUMENTS

| | | | | |
|---|---|---|---|---|
| 4,605,585 | A * | 8/1986 | Johansson | 442/2 |
| 5,152,326 | A | 10/1992 | Vöhringer | |
| 6,834,684 | B2 * | 12/2004 | Martin et al. | 139/383 A |
| 7,048,012 | B2 | 5/2006 | Martin et al. | 139/383 |
| 7,059,360 | B1 * | 6/2006 | Majaury et al. | 139/383 A |
| 7,108,019 | B2 | 9/2006 | Nagura et al. | 139/383 |
| 7,108,020 | B2 * | 9/2006 | Stone | 139/383 A |
| 2003/0217782 | A1 * | 11/2003 | Nagura et al. | 139/383 A |
| 2004/0020621 | A1 | 2/2004 | Hegar | |
| 2006/0048840 | A1 | 3/2006 | Quigley | 139/408 |
| 2006/0112999 | A1 | 6/2006 | Nagura et al. | 139/383 |

FOREIGN PATENT DOCUMENTS

| | | |
|---|---|---|
| WO | 2006/034576 | 4/2006 |

* cited by examiner

*Primary Examiner*—Eric Hug
(74) *Attorney, Agent, or Firm*—Taylor & Aust, P.C.

(57) ABSTRACT

The invention relates to a forming fabric, with a paper side fabric having paper side threads and with a wear side fabric having wear side threads. The paper side fabric and the wear side fabric are superimposed to one another and connected by binding threads weaving with both the paper side threads and the wear side threads, both extending in cross direction relative to the binding threads. The binding threads form part of the weave pattern of the paper side fabric and form part of the weave pattern of the wear side fabric, and alternate from weaving with the paper side fabric to weave with the wear side fabric and vice versa, thereby crossing each other forming crossing points. The wear side weave pattern is repeated by wear side repeat units, wherein the binding threads alternate such that one or less than one crossing point within each wear side weave repeat unit is formed and the ratio of the paper side threads to the wear side threads is greater than 1, and wherein the first and second binding threads alternate such that each of the first and second binding threads complete ≧1 repeats of a wear side weave repeat unit before exchanging onto the paper side.

7 Claims, 6 Drawing Sheets

COMPOUND PAPER MAKING FABRIC

CROSS-REFERENCE TO RELATED APPLICATIONS

The present application claims priority under 35 U.S.C. § 120 of U.S. patent application Ser. No. 11/159,986 now U.S. Pat. No. 7,431,802, filed on Jun. 22, 2005, the disclosure of which is expressly incorporated by reference herein in its entirety.

BACKGROUND OF THE INVENTION

1. Field of the Invention

The present invention relates to compound paper making fabrics, especially to forming fabrics, for use in a paper machine to manufacture a fibrous web.

2. Discussion of Background Information

Various styles of paper making fabrics, especially forming fabrics are known in the art.

EP 1 294 981 discloses a compound forming fabric for use in the forming section of a paper making machine comprising a paper side fabric and a wear side fabric being bound together by pairs of binding threads forming part of the weave pattern of the paper side fabric and part of the weave pattern of the wear side fabric and alternate from weaving with the paper side fabric to weave with the wear side fabric and vice versa, thereby crossing each other by forming crossing points. The forming fabric according to EP 1 294 981 shows per wear side weave repeat two crossing points. The structure has a high number of crossing points each of which destroys the planarity of the paper contacting side of the paper side fabric resulting in markings of the paper sheet.

In this manner, a warp exchange forming fabric is formed using two warp yarns that make a single knuckle with the wearside weft. The combination paths of these two exchanging warp yarns make up the wear side weave. However, the disadvantages include that the warp is weaving with the paperside for a limited length, thereby creating numerous exchange points per square meter. Each of these warp exchanges that results in a knuckle has the potential to form an indentation, or crater, resulting in uneven paper side fabric surface, which in turn has the high potential to "mark" the paper web and resultant paper sheet.

In EP 0 432 413, a compound forming fabric for use in the forming section of a paper making machine is disclosed whereby a paper side fabric and a wear side fabric are bound together by pairs of binding threads forming part of the weave pattern of the paper side fabric and part of the weave pattern of the wear side fabric and alternate from weaving with the paper side fabric to weave with the wear side fabric and vice versa. According to EP 0 432 413, the number of paper side weft yarns is similar to the number of wear side weft yarns, resulting in a structure having a relative coarse paper contacting surface because of the relative low number of paper side weft yarns per length unit, thereby leading to marking of the paper sheet formed on the fabric.

SUMMARY OF THE INVENTION

The present invention is directed towards providing a paper making fabric, especially a forming fabric, having improved smoothness of the paper contacting side leading to improved, and therefore less marking, of the paper sheet.

According to the present invention there is provided a compound paper making fabric, especially a forming fabric, with a paper side fabric having paper side threads and with a wear side fabric having wear side threads, the paper side fabric and the wear side fabric being superimposed onto one another and connected by binding threads weaving with the paper side threads and with the wear side threads both extending in cross direction relative to the binding threads, the binding threads forming part of the weave pattern of the paper side fabric and forming part of the weave pattern of the wear side fabric. The binding threads alternate from weaving with the paper side fabric to weave with the wear side fabric and vice versa, thereby crossing each other by forming crossing points, wherein the wear side weave pattern being repeated by wear side repeat units. Further, the binding threads alternate such that an average of one or less than one crossing point per wear side weave repeat unit is formed, and the ratio of the paper side threads to the wear side threads is greater than or equal to 1.0.

In another embodiment, the binding threads alternate such that an average of one or more than one repeat of the wear side weave repeat occurs before exchanging onto the paper side, and the ratio of the paper side threads to the wear side threads is greater than or equal to 1.0. In this manner, the number of warp exchange point is reduced.

Additionally, according to the present invention the number of crossing points is reduced to create an optimum balance to fulfil the requirement of achieving good binding between the paper side and the wear side fabric, thereby achieving the least possible crossing points that destroy the planarity of the paper contacting surface as well as leading to hydraulic marking on the paper sheet caused by the disturbance of the regular inner structure of the fabric. By further providing a ratio of paper side threads to wear side threads, both weaving with the binding threads and being greater than or equal to 1.0, the planarity and smoothness of the paper contacting surface can be improved, leading to a paper contacting surface having less tendency for marking the paper sheet compared to those from prior art fabrics.

It is understood that according to the present invention each wear side repeat unit or each second or each third repeat unit or each repeat unit being higher in number can comprise a crossing point.

In the preferred embodiment the ratio of paper side threads to wear side threads is 3:2 or 2:1. These threads can be weft threads in the case that the binding threads are warp threads and warp threads in the case that the binding threads are weft threads.

According to a preferred embodiment of the present invention the diameter of the paper side threads is less than the diameter of the wear side threads. The use of thicker yarns on the wear side compared to the yarns on the paper side leads to a fabric having a planar and smooth paper contacting surface and having a high wear resistance.

According to another embodiment of the present invention, at each crossing point the first of the binding threads extends in a direction thereby floating under a first number of consecutive paper side threads before passing under a wear side thread, and the second of the binding threads extends in a direction opposite to the direction of the first binding thread thereby floating under a second number of consecutive paper side threads before passing under a wear side thread, wherein the first number is not equal to the second number.

According to another embodiment of the present invention the whole paper side fabric is formed by the paper side threads weaving with the binding threads and the whole wear side fabric is formed by the wear side threads weaving with the binding threads.

BRIEF DESCRIPTION OF THE DRAWINGS

The present invention if further described in the detailed description which follows, in reference to the noted drawing by way of non-limiting example of exemplary embodiment of the present invention, and wherein.

DETAILED DESCRIPTION OF THE PRESENT INVENTION

The particulars shown herein are by way of example and for purposed of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1A:
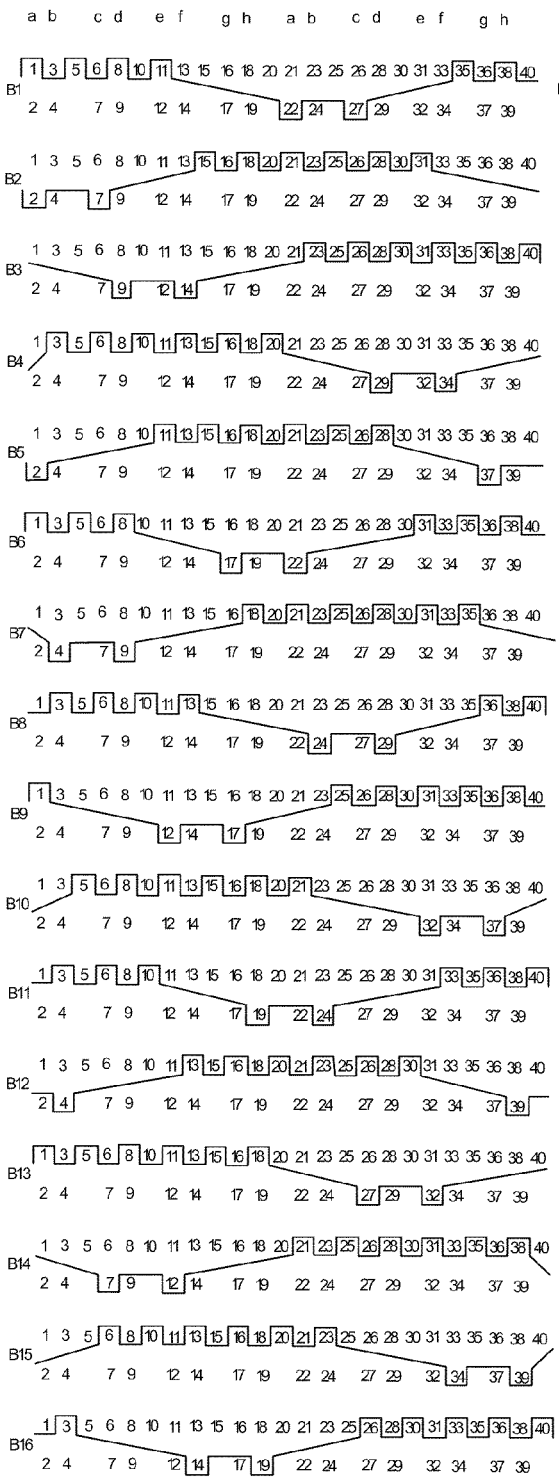
FIGS. 1A-1B show the full weave repeat of a forming fabric according to the present invention in the warp yarn direction.

FIG. 1*a* shows the weave paths of 16 consecutive binding threads B1 to B16 forming the full weave repeat by weaving with paper side weft threads 1, 3, 5, 6, 8, 10, 11, 13, 15, 16, 18, 20, 21, 23, 25, 26, 28, 30, 31, 33, 35, 36, 38 and 40 and by weaving with wear side threads 2, 4, 7, 9, 12, 14, 17, 19, 22, 24, 27, 29, 32, 34, 37 and 39.

The binding threads are arranged in pairs, for example, pair B1,B2; pair B3,B4 etc., such that each pair together weaves a full weave path on the paper side and on the wear side. By doing this the binding threads alternate from weaving with the paper side threads to weave with the wear side threads and vice versa, thereby crossing each other by forming two different types of crossing points A and B. This is best illustrated in FIG. 1B.

The weave pattern of the wear side is formed by wear side repeat units a through h having eight wear side threads. The weave pattern on the paper side is a linen binding weave pattern.

Figure 1B:
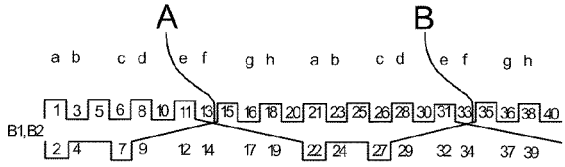

The embodiment shown in FIGS. 1A-1B provides binding threads alternating such that only one crossing point within each wear side weave repeat unit a through h is formed and that the ratio of the paper side threads to the wear side threads is 3:2, and therefore greater than 1.

Figure 2:
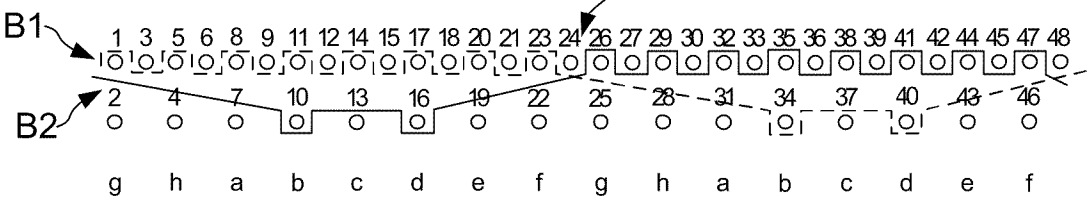
FIG. 2 shows the weave paths of two consecutive binding threads extending in the warp direction of a forming fabric according to the present invention.

FIG. 2 shows another embodiment of a fabric according to the invention. In FIG. 2, the weave paths of two consecutive binding threads B1 and B2 extending in the warp direction and weaving with paper side threads 1, 3, 5, 6, 8, 9, 11, 12, 14, 15, 17, 18, 20, 21, 23, 24, 26, 27, 29, 30, 32, 33, 35, 36, 38, 39, 41, 42, 45, 47, 48 and wear side threads 2, 4, 7, 10, 13, 16, 19, 22, 25, 28, 31, 34, 37, 40, 43, 46 in a manner similar to the one described in FIG. 1*a* are shown. The ratio of paper side weft threads to wear side weft threads is 2:1. As in FIG. 1*a* and according to the invention, the fabric provides for each wear side weave repeat unit a through h only one crossing point A or B.

Figure 3:
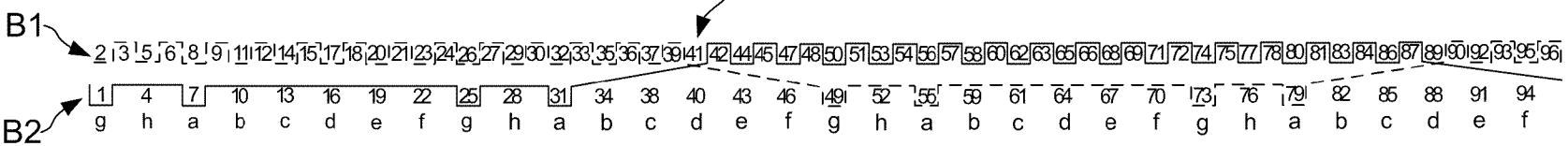
FIG. 3 shows the weave paths of two consecutive binding threads extending in the warp direction of another forming fabric according to the present invention.

FIG. 3 shows another embodiment of the present invention. The weave paths of two consecutive binding threads B1, B2 extending in the warp direction and weaving with paper side threads 2, 3, 5, 6, 8, 9, 11, 12, 14, 15, 17, 18, 20, 21, 23, 24, 26, 27, 29, 30, 32, 33, 35, 36, 37, 39, 41, 42, 44, 45, 47, 48, 50, 51, 53, 54, 56, 57, 58, 60, 62, 63, 65, 66, 68, 69, 71, 72, 74, 77, 78, 80, 81, 83, 84, 86, 87, 89, 90, 92, 93, 95, 96 and wear side threads 1, 4, 7, 10, 13, 16, 19, 22, 25, 28, 31, 34, 36, 40, 43, 46, 49, 52, 55, 58, 61, 64, 67, 70, 73, 76, 78, 82, 85, 88, 91, 94 in a manner similar to the one described in FIG. 1*a*. In FIG. 3, the ratio of paper side to wear side weft yarns is 2:1. In contrast to FIGS. 1*a* and 2, and according to the present invention, the fabric provides only every second wear side weave repeat unit a crossing point such that per weave repeat unit having an average ½ crossing point is formed.

Figure 4:
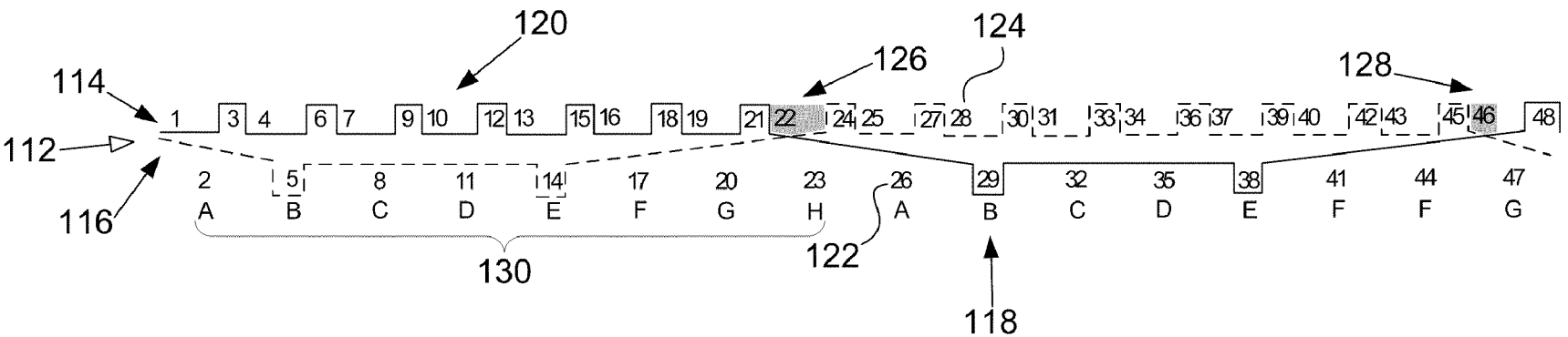
FIG. 4 shows a full weave repeat of a forming fabric according to a second embodiment of the present invention in the warp yarn direction having a 2:1 cross-direction ratio and 48 wefts in the weave repeats.

FIG. 4 shows a second embodiment of a fabric 110 having a full weave repeat having 48 weft yarns in the weave repeat and a CD ratio of 2:1.

The binding threads 112 are arranged in pairs, for example, warp1 114 and warp2 116. The pair of binding threads 114, 116 together weave a full weave path on the paper side 118 and on the wear side 120. By doing this the binding threads 112 alternate from weaving with the paper side threads 122 to weave with the wear side threads 124 and vice versa, thereby crossing each other by forming two different types of crossing points 126,128.

The weave pattern of the wear side 120 is formed by wear side repeat units a through h 130 having eight wear side threads 124. The weave pattern on the paper side 118 is a linen binding weave pattern.

The embodiment shown in FIG. 4 provides binding threads 114,116 alternating such that only one crossing point 126 within each wear side weave repeat unit a through h 130 is formed and that the ratio of the paper side threads 122 to the wear side threads 124 is 2:1, and therefore greater than 1.

Figure 5:
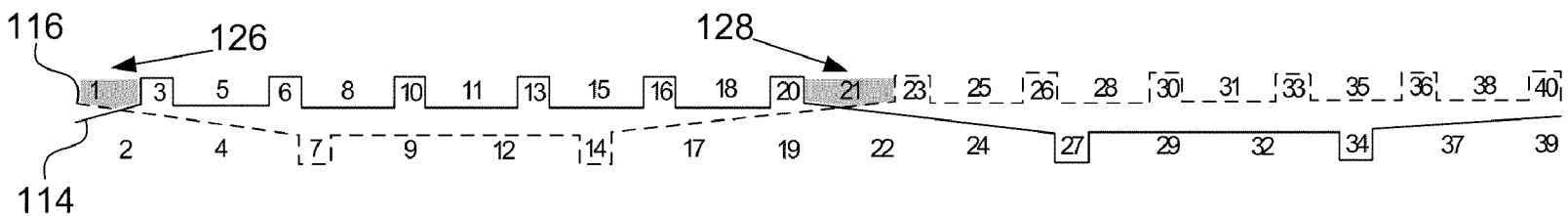
FIG. 5 shows a full weave repeat of a forming fabric according to a second embodiment of the present invention in the warp yarn direction having a 3:2 cross-direction ratio and 40 wefts in the weave repeats.

FIG. 5 shows another embodiment of a fabric according to the invention in which the fabric 110 has a full weave repeat having 40 weft yarns in the weave repeat and a CD ratio of 3:2. As in FIG. 4 and according to the invention, the fabric provides for each wear side weave repeat unit a through h 130 with crossing points 126,128.

Figure 6:
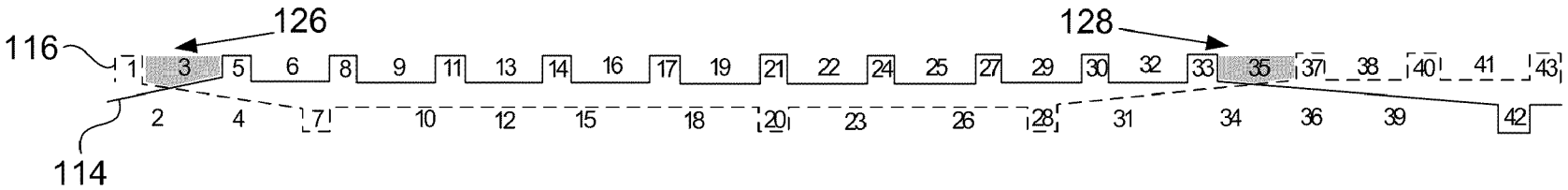
FIG. 6 shows a full weave repeat of a forming fabric according to a second embodiment of the present invention in the warp yarn direction having a 5:3 cross-direction ratio and 64 wefts in the weave repeats.

FIG. 6 shows another embodiment of the fabric 110 present invention in which the fabric 110 has a full weave repeat having 64 weft yarns in the weave repeat and a CD ratio of 5:3. As in FIG. 4 and according to the invention, the fabric provides for each wear side weave repeat unit a through h 130 with crossing points 126,128.

Figure 7:
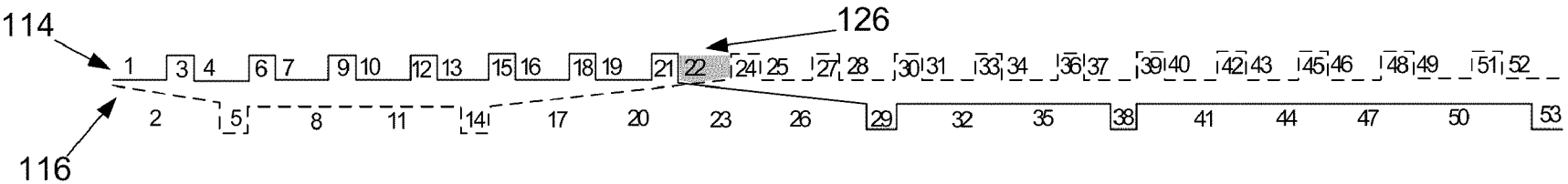
FIG. 7 shows a full weave repeat of a forming fabric according to a second embodiment of the present invention in the warp yarn direction having a 2:1 cross-direction ratio and 72 wefts in the weave repeats with 1.5 weave side repeat per warp exchange repeat.

FIG. 7 shows another embodiment of the fabric 110 present invention in which the fabric 110 has a full weave repeat having 72 weft yarns in the weave repeat and a CD ratio of 2:1, along with 1.5 warp exchange crossing points 126,128 per wear side repeat 130.

Figure 8:
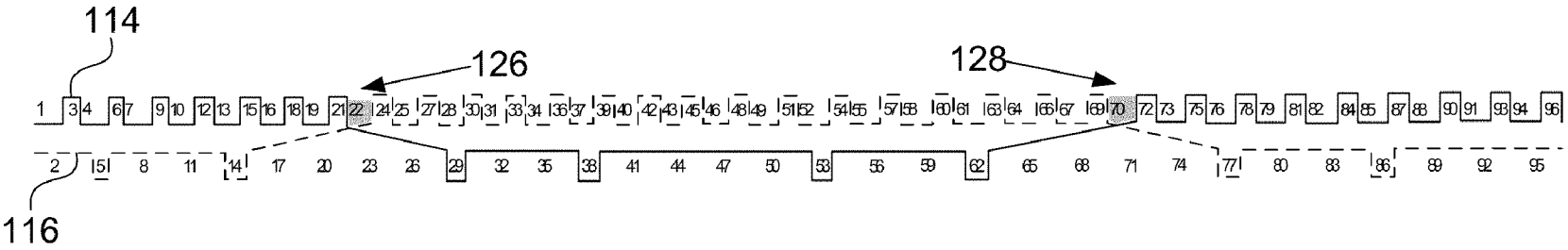
FIG. 8 shows a full weave repeat of a forming fabric according to a second embodiment of the present invention in the warp yarn direction having a 2:1 cross-direction ratio and 96 wefts in the weave repeats with greater than 1 weave side repeat per warp exchange.

FIG. 8 shows another embodiment of the fabric 110 present invention in which the fabric 110 has a full weave repeat having 96 weft yarns in the weave repeat and a CD ratio of 2:1, along with one warp exchange crossing points 126,128 per wear side repeat 130.

Figure 9:
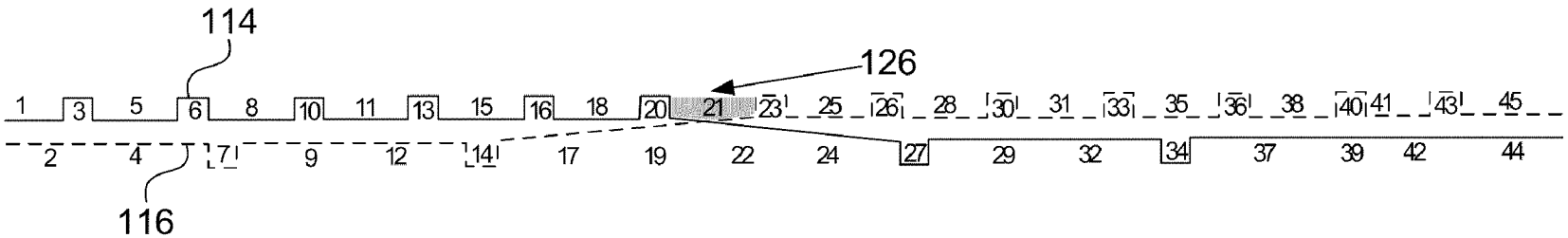
FIG. 9 shows a full weave repeat of a forming fabric according to a second embodiment of the present invention in the warp yarn direction having a 3:2 cross-direction ratio and 80 wefts in the weave repeats with greater than 1 weave side repeat per warp exchange.

FIG. 9 shows another embodiment of the fabric 110 present invention in which the fabric 110 has a full weave repeat having 80 weft yarns in the weave repeat and a CD ratio of 3:2. As in FIG. 1 and according to the invention, the fabric provides for each wear side weave repeat unit a through h 130 with crossing points 126,128.

I can also be seen that for FIGS. 4-9, the paper side 122 has a ¼ plain weave, which is illustrated for example, and is not to be considered limiting.

Figure 10:
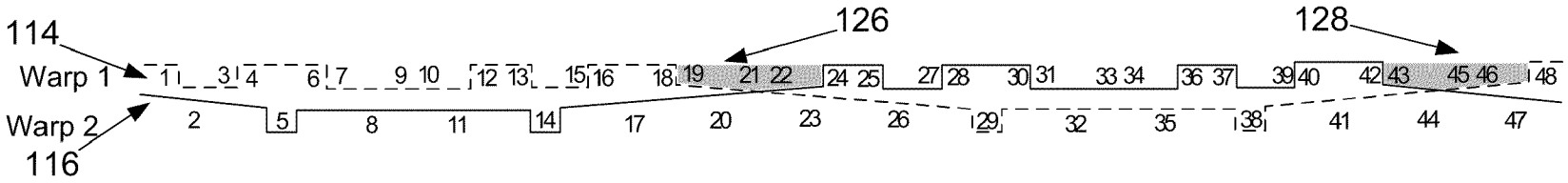
FIG. 10 shows a full weave repeat of a forming fabric according to a second embodiment of the present invention in the warp yarn direction having a 2:1 cross-direction ratio and 48 wefts in the weave repeats with 1 weave side repeat per warp exchange and a textured paper side weave.

FIG. 10 shows another embodiment of the fabric 110 present invention in which the fabric 110 has a full weave repeat having 48 weft yarns in the weave repeat and a CD ratio of 2:1, along with one warp exchange crossing point 126 per wear side repeat 130.

Figure 11:
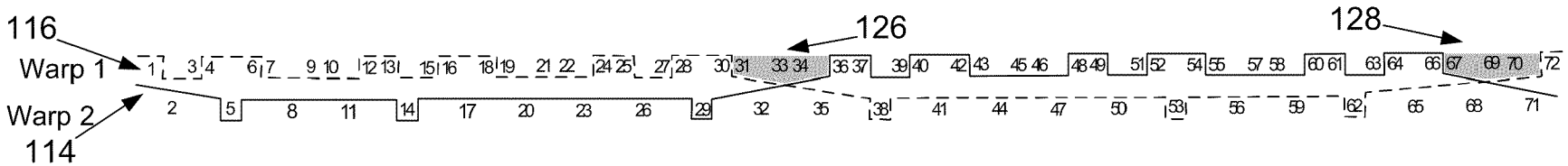
FIG. 11 shows a full weave repeat of a forming fabric according to a second embodiment of the present invention in the warp yarn direction having a 2:1 cross-direction ratio and 72 wefts in weave repeats with 1.5 weave side repeat per warp exchange and a textured paper side weave.

FIG. 11 shows another embodiment of the fabric 110 present invention in which the fabric 110 has a full weave repeat having 72 weft yarns in the weave repeat and a CD ratio of 2:1, along with 1.5 warp exchange crossing points 126,128 per wear side repeat 130.

It can also be seen that for FIGS. 10-11 the paper side 122 has a "textured" weave, which is illustrated for example, and is not to be considered limiting.

Still further, for FIGS. 4-11, the wear side weft float length is 6/2.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A compound paper making fabric comprising:

a paper side fabric having paper side threads, a wear side fabric having wear side threads and superimposed onto the paper side fabric, the wear side fabric and the paper side fabric connected by a first binding thread and a second binding thread, wherein the first binding thread and the second binding thread are woven with the paper side threads and with the wear side threads both extending in a cross direction relative to the first and second binding threads, the first and second binding threads forming a part of a first weave pattern of the paper side fabric and forming part of a second weave pattern of the wear side fabric, wherein the first and second binding threads alternate from weaving with the paper side fabric and the wear side fabric, thereby forming a plurality of crossing points, wherein the second weave pattern has a predetermined wear side weave repeat unit, wherein the binding threads alternate such that one or less than one crossing point within each wear side weave repeat unit is formed and the ratio of the paper side threads to the wear side threads is one of 3:2 and 5:3, wherein the first and second binding threads alternate such that each of the first and second binding threads complete ≧1 repeats of a wear side weave repeat unit before exchanging onto the paper side, wherein the paper side fabric has a plain weave formed by the paper side threads and the first and second binding threads.

2. The fabric of claim 1, wherein a diameter of the paper side threads is less than a diameter of the wear side threads.

3. The fabric of claim 1, wherein at each crossing point the first binding thread extends in a first direction thereby floating under a first number of consecutive paper side threads before passing under a wear side thread and the second binding thread extends in a direction opposite to the direction of the first binding thread thereby floating under a second number of consecutive paper side threads before passing under a wear side thread.

4. The fabric of claim 1, wherein the first and second binding threads are warp threads and wherein the paper side threads and the wear side threads are weft threads.

5. The fabric of claim 1, wherein the paper side fabric is formed by the paper side threads weaving with the binding threads and wherein the wear side fabric is formed by the wear side threads weaving with the binding threads.

6. The fabric of claim 1, wherein the binding threads are warp yarns.

7. The fabric of claim 1, wherein the binding threads are weft yarns.

* * * * *